United States Patent [19]

Fleming

[11] 4,162,754

[45] Jul. 31, 1979

[54] COMBINATION WATCHBAND AND WRITING INSTRUMENT

[76] Inventor: Charlie Fleming, 1511 Fulton St., Brooklyn, N.Y. 11216

[21] Appl. No.: 863,212

[22] Filed: Dec. 22, 1977

[51] Int. Cl.[2] ..... G04B 47/00; A44C 5/00

[52] U.S. Cl. ..... 224/165; 401/195

[58] Field of Search ..... 224/28 R, 28 A, 28 B, 224/28 C, 28 D, 28 E, 28 P, 28 W, 4 A, 4 B, 4 D, 5 R, 5 A, 5 B, 5 H; 63/1 R, 1 A, 3, 5 R, 5 A; 401/195, 209, 210, 214; 206/38; D45/1 R, 4 R, 4 A, 4 D, 4 E

[56] References Cited

U.S. PATENT DOCUMENTS

| | | | |
|---|---|---|---|
| 1,407,239 | 2/1922 | Weiss | 224/28 D UX |
| 2,191,314 | 2/1940 | Davis | 224/28 W X |
| 3,303,977 | 2/1967 | Coppen | 224/28 R X |

FOREIGN PATENT DOCUMENTS

| | | | |
|---|---|---|---|
| 373981 | 1/1964 | Switzerland | 401/209 |

*Primary Examiner*—Robert J. Spar
*Assistant Examiner*—Jerold M. Forsberg
*Attorney, Agent, or Firm*—Friedman, Goodman & Teitelbaum

[57] ABSTRACT

A watchband supporting a watch which provides a pliant and ductile characteristic permitting it to be flexed and maintained between a straight position and a position around a wrist. A ball point pen having a flexible barrel portion is accommodated within the watchband with its point extending from one end of the band. An end cap mounted on the band includes a pivoted knob which can selectively expose or enclose the point of the pen and can provide access to the ballpoint pen.

12 Claims, 6 Drawing Figures

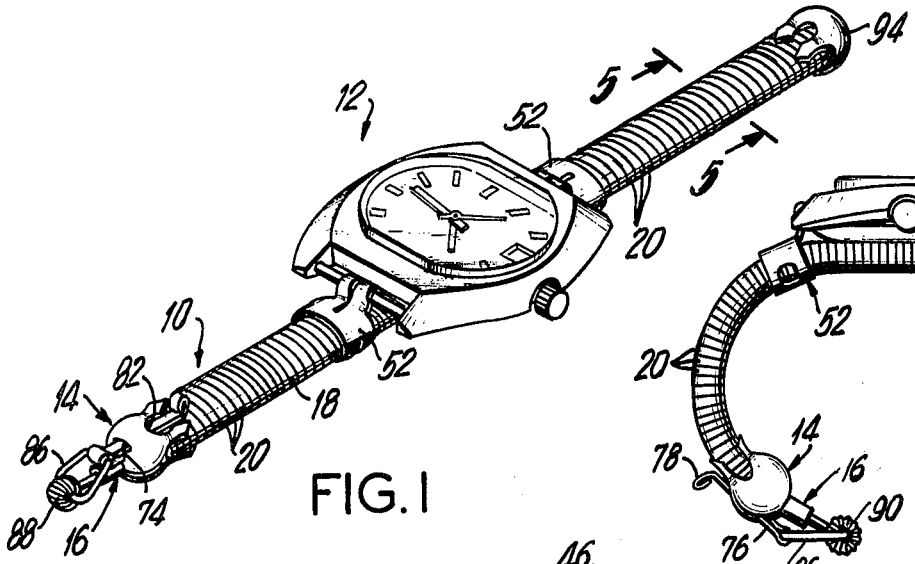
FIG. 1
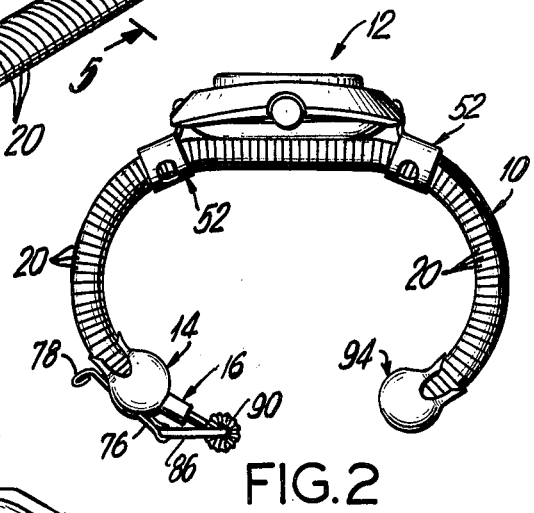
FIG. 2
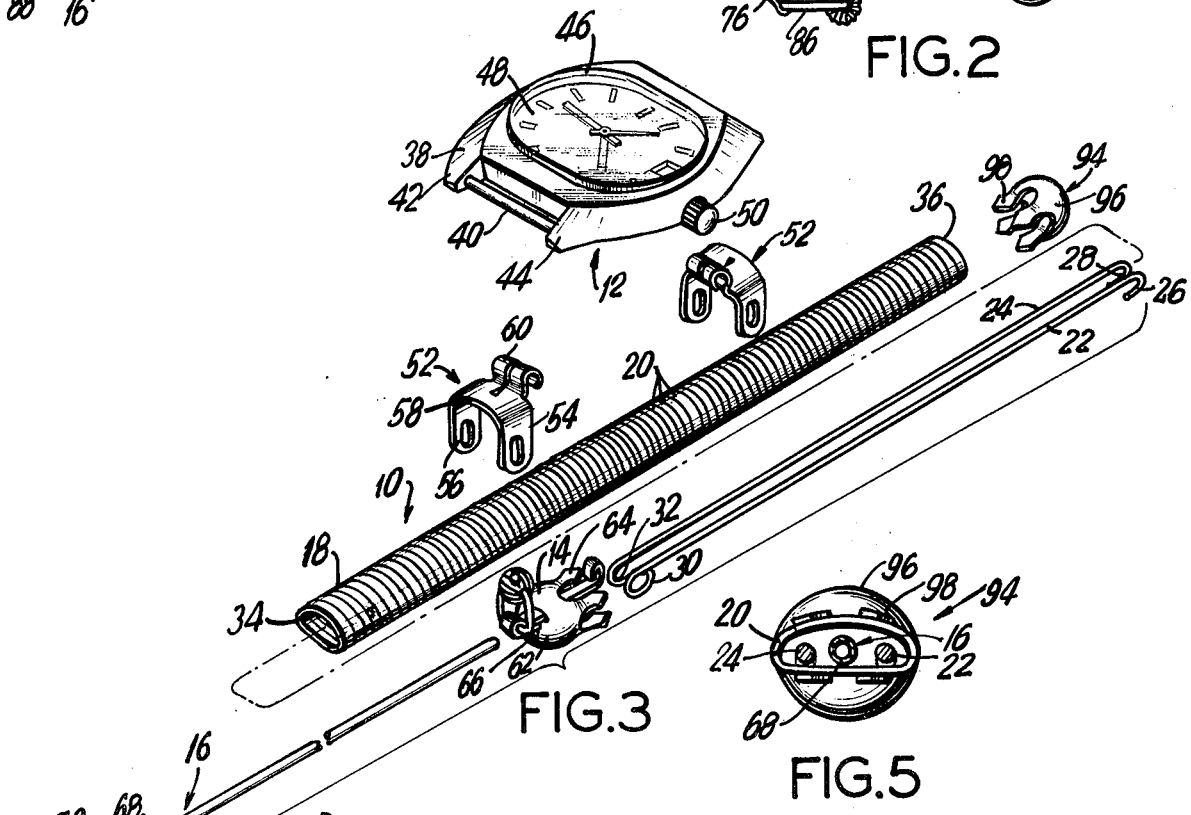
FIG. 3
FIG. 5
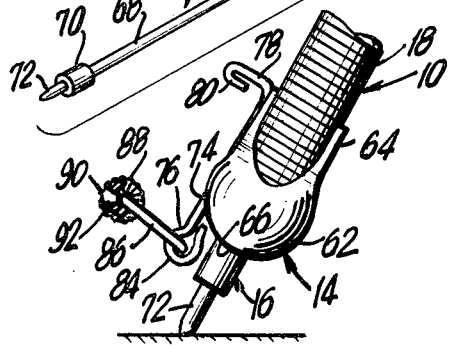
FIG. 4
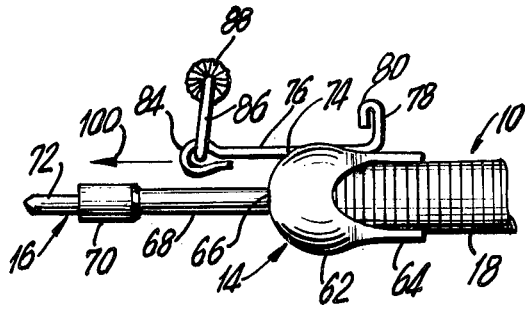
FIG. 6

COMBINATION WATCHBAND AND WRITING INSTRUMENT

BACKGROUND OF THE INVENTION

This invention relates to an improved watchband, and more particularly to a watchband which accommodates a writing instrument.

A most annoying problem is to require the need of a writing instrument, such as a ballpoint pen, and to find none readily available. While many people customarily carry writing instruments, especially ballpoint pens, in many situations modern day clothing makes it difficult to conveniently carry such a pen. For example, sport shirts are often made without any pockets and likewise many skirts do not have pockets. As a result, the ball point pen must be carried in an awkward position where it can be uncomfortable to the wearer or must be carried in a separate carrying case such as a pocketbook or wallet.

Frequent attempts have been made to provide the availability of a ballpoint pen without the need of carrying one in a pocket. For example, keychains have been designed to have ballpoint pens carried in special designed cases. Similarly, bracelets, necklaces, pins, and other types of jewelry are often designed to accommodate a ballpoint pen. The approach of all of these devices is to include the ballpoint pen in such a way that it does not have to be separately carried, but can still be exposed and is readily available when needed. However, the problem with these devices, is that the device itself is usually designed only for the ballpoint pen. For example, in a combination pen and pin, the only purpose of the pin is to provide the availability of the pen, similarly, for the necklace or the other jewelry. As a result, it is most difficult to conceal the shape of the pen and the jewelry or like object is unappealing. Also, since the whole purpose of having the device is to have the pen available, it becomes a superfluous item to be carried or worn.

SUMMARY OF THE INVENTION

The purpose of the present invention is to provide a watchband which includes the availability of a writing instrument, such as a ballpoint pen. Most people wear a watch having a watchband which encircles the wrist. Heretofore, little if any consideration has been given to utilizing the watchband for other purposes besides retaining the watch onto the wrist. However, the watchband is actually a most useful place for supporting a writing instrument such as a ballpoint pen. The watchband itself can conceal the pen and avoids its unattractive appearance, and at the same time it can be made easily available when needed.

The problem, however, is to avoid the possibility of having the ballpoint pen, especially its tip, soil something or harm the wearer by puncturing the skin or scratching the individual. Accordingly, selective access must be provided to the pen so that under normal use, while the pen is stored in the watchband, it is prevented from harming the wearer and damaging or soiling his clothes. At the same time, when desired, the pen should be readily available for use and should be easy to manipulate and simple to access. It must also be possible to change the ballpoint pen as one runs dry, or to selectively change the color of the pen by altering the type of ballpoint pen used.

It is therefore an object of the present invention to provide a watchband which provides selective access to a writing instrument stored therein.

Another object of the present invention is to provide a flexible watchband which supports a watch and which also accommodates a ballpoint pen.

A further object of the present invention is to provide a watchband which is pliant and ductile, and which accommodates a ballpoint pen which can be selectively exposed.

Still another object of the present invention is to provide a watchband having a flexible band member which stores a ballpoint pen, and includes a cover which can selectively expose the point of the pen thereby providing the availability of using the pen.

Another object of the present invention is to provide a watchband which accommodates a ballpoint pen, and wherein the ballpoint pen is appropriately positioned within the watchband to provide its selective use while still maintaining the beauty and attractiveness of the watchband.

Briefly, the invention comprises a watchband which has a tubular flexible band member. The band member is formed of a helical coil having closely adjacent turns, with stiffening rods positioned in the coil for providing a pliant and ductile characteristic to the coil so that the coil can be bent and maintained in a desired shape. Bent clips are available for interconnecting a watch onto the flexible band member. An end cap connected to one end of the band member provides selective access to the pen accommodated within the band member. The cap includes a substantially spherical portion with fingers which can be crimped onto the flexible band member. An axial hole in the cap accommodates passage therethrough of the flexible barrel of a ball point pen while preventing the larger collar portion of the pen from passing therethrough, whereby the collar and point of the pen extend outwardly from the end cap. A slot in the end cap receives a slidng bar having an actuating arm at one end for accommodating sliding of the bar, and a pivoted knob at the other end of the bar is provided with an axial hole, which knob can fit over and enclose the point of the ballpoint pen. The opposite end of the band also has a spherical end cap, were the end caps retain the stiffening rods at opposite ends thereof.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which:

FIG. 1 is an isometric view of the watchband in accordance with the present invention;

FIG. 2 is a side view showing the watchband in flexed position for fitting around a wrist;

FIG. 3 is an exploded view of the watchband in accordance with the present invention;

FIG. 4 is a partial side view of the watchband specifically showing the end cap with the knob cover removed, thereby providing access to the writing instrument;

FIG. 5 is a sectional view taken along line 5—5 of FIG. 1; and

FIG. 6 is a side view showing the end cap and the removal and replaceability of the writing instrument.

In the various figures of the drawing like reference characters designate like parts.

DETAILED DESCRIPTION OF THE PREFERRED EMBODIMENT

Referring now to the drawings, the watchband of the present invention is shown generally at 10 and is utilized to support a watch, shown generally at 12. An end cap 14 provides selective accessability to a ballpoint pen 16, the pen 16 being accommodated within the watchband so that the pen can be selectively exposed for use, as shown specifically in FIG. 4.

The watchband includes a flexible band member 18 which is formed of a helical coil having closely adjacent turns 20. The band member is tubular and is extremely flexible, whereby it can be easily twisted into a desired shape but cannot itself retain that shape. Accordingly, joined stiffening rods 22, 24 are inserted within the tubular flexible band member with its separated hooked ends 26, 28 and its joined together hooked ends (or looped end) 30, 32, respectively connected to opposing ends 36, 34 of the helical coil in hooked on relationship so that the ends are disposed outside the band member.

The stiffening material, for example, is made of steel rods and provides a pliant characteristic to the coil so that it can easily be bent into a desired shape. At the same time, it provides a ductile characteristic to the coil so that once it is fashioned into the new shape, it retains the set configuration of the new shape. Specifically, the watchband can be bent into a horizontal straight shape as shown in FIG. 1 for writing, or can be flexed into a curved position shown in FIG. 2 to fit around a wrist. The shape will maintain its position as set, but can still be easily flexed into another desired position. In this manner the watchband can fit over various sized wrists. Furthermore, it can be flexed back to a straight position as shown in FIG. 1 to give access to the writing instrument and to permit removal and replacement of the writing instrument.

The conventional watch 12 includes the usual watchcase 38 having spring loaded pins 40 connected to tabs 42, 44 at the end of the watchcase. A watch crystal 46 covers the watch face 48, under which is the conventional watch mechanism (not shown) which is operated by the winding stem 50.

U-shaped clips, shown generally at 52, are provided to interconnect the watch 12 to the watchband 10. The U-shaped clips include leg portions 54, 56 and an interconnecting bight portion 58. A U-shaped hook 60 extends from one side of the bight portion.

To interconnect the watch onto the watchband, the hooks 60 are placed over the spring loaded pins 40 and tightened around them or the pins 40 are passed through the turned hooks in a conventional manner. The legs 54, 56 of the U-shaped clips 52 are placed around the band member 18 and are bent underneath and tightly against the band member, as shown in FIGS. 1 and 2, so that the clips can retain the watch in place against the surface of the band member with no sliding relationship therebetween.

End cap 14 is placed over the end 34 of the band member and over the joined together hooked ends 30, 32 which are disposed on the outside of the band member to retain the ends 30, 32 in place. The end cap includes a substantially spherical portion 62 with axially extending pointed fingers 64 extending therefrom which fingers can be crimped against the helical coil to retain the end cap 14 in secured position on the coil end 34.

The end cap 14 includes an axial hole 66 which is of a size to accommodate passage therethrough of the barrel portion of the pen 68 but is smaller than the collar 70 of the pen so that the collar 70 is retained outside the watchband, as shown in FIG. 4, although the barrel 68 is within the band, as shown in FIG. 5. It should be noted that with the collar disposed out of the watchband, the writing point 72 connected to the collar 70 will also be outward of the watchband.

A slot 74 is formed through the spherical end cap, above the axial hole 66 to slidably receive a connecting bar 76. At the rear end of the connecting bar is an upwardly turned portion or actuating arm 78 with a U-shaped end 80 which serves for actuating or moving the bar 76 through the slot 74. At the same time, the arm 78 provides a stop for the forward movement of the bar 76 by abutting against the edge 82 of the cap member itself.

The front end of the connecting bar 76 terminates in a loop 84 through which passes a looped wire ring 86 having a ball or knob 88 pivoted about a portion of the wire ring. A hole 90 is formed in the ball, as best seen in FIG. 4. Rubber, or similar material 92, is disposed inside the ball around the hole 90.

At the opposite end 36 of the flexible band member 18 is placed another end cap 94 having a spherical portion 96 and axially extending pointed fingers 98 available for crimping against the coil. The end cap 94 is placed over the hooked ends 26, 28 which are disposed on the outside of the band member to retain the ends 26, 28 in place. The end cap 94 substantially matches the end cap 14, as can best be seen in FIG. 2.

In operation, a ballpoint pen 16 is passed through the axial hole 66 in the end cap 14 so that the barrel portion 68 is inserted within the tubular flexible band member. Typically, the ballpoint pen includes the flexible barrel portion 68 having the collar 70 at one end, from which extends the writing point 72.

The pen is inserted until its collar abuts the spherical end cap. The actuating arm 78 is then pushed towards the end 34 so that the sliding bar 76 moves forward in the slot of the end cap. The wire ring 86 and the ball 88 are then pivoted downwardly, and the hole 90 is aligned with the writing point 72 of the ballpoint pen. The bar 76 is then moved rearwardly through its slot 74 until the hole 90 tightly covers or encloses the point 72, the enclosed position being best shown in FIGS. 1 and 2. The rubber material 92 in the hole 90 provides a tight fit onto the point 72 and prevents it from loosening while protecting same. In this enclosed position, the writing point cannot soil anything or cause any harm to the wearer or other individual.

In its closed configuration, the watch can be worn where the band can be appropriately flexed to fit over the wrist. The ballpoint pen will accommodate its shape according to the flexing of the band, and will thereby be retained within the watchband without interferring with the use of the watchband as a normal support for a watch when in its normal retention around the wrist.

When it is desired to have access to the pen, the watchband, and especially the end containing the pen, can be straightened out. The connecting bar 76 is then moved forward by means of the actuating arm 78 so that the ball 88 will move away from the point 72 to expose it. The ball can then be moved upward and the bar 76 moved rearward so that the ball is out of the way of the point, thereby exposing the point and making it available for writing, as shown in FIG. 4. After completion of writing, the point is again covered as heretofore explained.

Normally the pen will be retained in the watchband by means of the tight fit between the barrel portion 68 and the hole 66 contained in the end cap 14. Also, because of the angular flexing of the watchband, the ballpoint pen will be prevented from sliding in and out of the watchband. However, when it is desired to change the ballpoint pen, such as when it is used up, or to change the color of the ballpoint pen, the pen can be easily removed by pulling it in the direction shown by the arrow 100 shown in FIG. 6, whereby the ballpoint pen is pulled out of its position in the flexible watchband and can be easily replaced by another pen.

Although a ballpoint pen has been described, it can be understood that other similar types of writing instruments can be accommodated so long as they include a flexible barrel portion with a front tip extending therefrom. Similarly, other types of coupling means can be used to interconnect the watch and the flexible band member. Also, other various changes can be made in the end cap means to facilitate selective exposure of the point, and thereby provide selective access to the pen when desired.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A watchband comprising:

a tubular flexible band member;

coupling means for connecting a watch onto the band member;

a flexible writing instrument removably disposed in and along the length of said band member with a writing point extending outwardly from one end of said band member;

stiffening means positioned in said band member for providing a pliant and ductile characteristic to the band member, whereby the flexible band member and stiffening means may be bent to conform to the wearer's wrist and easily straightened again for use of the watchband as a pen;

an end cap connected to said one end of said band member;

said end cap being provided with cover means for selectively providing access to said writing point.

2. A watchband as in claim 1, wherein said band member comprises a helical coil having closely adajcent turns.

3. A watchband as in claim 2, wherein said stiffening means comprise elongated wires extending through said tubular flexible band member, and hooks disposed at opposite ends of said wires for connecting to said opposite ends to said one end and an opposing end of said band member.

4. A watchband as in claim 1, wherein said coupling means comprise U-shaped clips, each of said clips having leg portions interconnected by a bight portion, said leg portions being clamped around said flexible band member, and hook means extending from each said bight portion for securing the watch onto said clips which are secured around said band member.

5. A watchband as in claim 1, wherein said end cap includes a hollow partially spherical member securely fitting over said one end of said flexible band member, an axial hole being provided in said spherical member for receiving therein a cylindrical flexible barrel of said writing instrument, and said cover means extending from said spherical member for covering said point of said writing instrument.

6. A watchband as in claim 5, wherein said spherical member further comprises a transverse slot spaced from said axial hole, and wherein said cover means comprise:

a sliding bar extending through said slot;

actuator means disposed at one end of said bar for facilitating sliding of said bar through said slot; and ball-like means pivotally coupled to an opposite end of said bar for swinging over and away from said point of said writing instrument extending from said spherical member, said ball-like means being provided with a hole for receiving said point of said writing instrument.

7. A watchband as in claim 6, wherein said actuating means comprise an upwardly extending arm integrally connected to said bar, said upwardly extending arm providing a stopping limit for forward movement of said sliding bar towards said writing point.

8. A watchband as in claim 6, wherein said bar further comprises a loop disposed at said opposite end thereof, a wire ring pivotally passing through said loop, and wherein said ball-like means is pivotally connected to said wire ring.

9. A watchband as in claim 5, wherein said writing instrument includes a collar portion interconnecting said writing point to said barrel, and wherein said axial hole in said spherical member is sized to pass said barrel and to stop said collar portion, whereby said barrel can be positioned in said flexible band member with said collar portion and writing point extending outwardly from said flexible band member.

10. A watchband as in claim 5, wherein said spherical member further comprises finger portions crimped onto said flexible band member for securing said spherical member in position onto said band member.

11. A watchband as in claim 5 and further comprising a second partially spherical end cap fitted over an opposing end of said flexible band member.

12. A watchband as in claim 6 and further comprising resilient means disposed within said ball-like means and around said hole therein for engaging said writing point.

* * * * *